United States Patent [19]

Fritsch

[11] 4,430,048

[45] Feb. 7, 1984

[54] DIAPHRAGM PUMP WITH A DIAPHRAGM CLAMPED IN PRESSURE-BALANCING ARRANGEMENT

[75] Inventor: Horst Fritsch, Leonberg, Fed. Rep. of Germany

[73] Assignee: Lewa Herbert Ott GmbH & Co., Leonberg, Fed. Rep. of Germany

[21] Appl. No.: 335,410

[22] Filed: Dec. 29, 1981

[30] Foreign Application Priority Data

Dec. 29, 1980 [DE] Fed. Rep. of Germany ..... 3049341

[51] Int. Cl.[3] ..... F04B 43/06

[52] U.S. Cl. ..... 417/383; 417/389; 417/395; 92/86; 92/98 R

[58] Field of Search ..... 92/82, 86, 98 R, 99, 92/100, 102; 417/383, 388, 389, 395

[56] References Cited

U.S. PATENT DOCUMENTS

| | | | |
|---|---|---|---|
| 2,202,313 | 5/1940 | Grove | 92/82 X |
| 2,348,248 | 5/1944 | Elliott | 92/98 R X |
| 2,575,398 | 11/1951 | Schroeder | 92/99 X |
| 2,578,746 | 12/1951 | Scherger et al. | 417/388 |
| 2,693,827 | 11/1954 | Bailey | 92/99 |
| 2,907,339 | 10/1959 | Reinecke et al. | 92/98 R |
| 2,916,255 | 12/1959 | Koehler | 92/99 X |
| 3,661,060 | 5/1972 | Bowen | 92/102 |

*Primary Examiner*—Leonard E. Smith

*Attorney, Agent, or Firm*—Fleit, Jacobson, Cohn & Price

[57] ABSTRACT

In a diaphragm pump the diaphragm separating the delivery chamber from the working chamber is clamped between a cylinder body and a cylinder cover in pressure-balancing arrangement. For this purpose a pressure-balancing space is provided to be radially outside and to encircle said diaphragm clamping surface, the pressure balancing space communicating wtih the working chamber through at least one communicating passage. Furthermore, a separate annular seal member is disposed to be radially outside the pressure balancing space chamber between the cylinder cover and the cylinder body to seal-off the pressure balancing space and the working chamber from the outside. This enables the diaphragm pump to be used at discharge pressures far greater than 350 bars and simultaneously permits the use of plastic diaphragms which are reliable in operation and have a large displacement capacity.

13 Claims, 4 Drawing Figures

DIAPHRAGM PUMP WITH A DIAPHRAGM CLAMPED IN PRESSURE-BALANCING ARRANGEMENT

FIELD OF THE INVENTION

The invention relates to a diaphragm pump including at least one diaphragm separating a delivery chamber from a working chamber filled with a hydraulic medium, the diaphragm being firmly clamped between a cylinder body and a cylinder cover at a clamping surface formed by the peripheral edge portion of the diaphragm, and further including hydraulic diaphragm drive means in the form of a reciprocating displacement piston slidably disposed within the cylinder body between the working chamber and a hydraulic fluid reservoir.

DESCRIPTION OF THE PRIOR ART

Known diaphragm pumps of the above kind, which operate using hydraulic diaphragm drive means, are of two basic designs. One of these makes use of a plastic diaphragm or a plurality of such diaphragms, whereas the other employs metal diaphragms.

Diaphragm pumps of known design using a plastic membrane, usually made of PTFE or elastomers, provide the advantages of being compact, cheap and very reliable in operation, so that these pumps are mainly used nowadays. This is due to the fact that a plastic diaphragm is highly resilient by nature and therefore permits very large deformations to be achieved and small diameters to be used. Plastic diaphragms are also not prone to surface damage, so that even when pumping difficult materials, such as suspensions, high reliability of operation is achieved, which manifests itself in the attainment of diaphragms lifetimes of more than 20,000 operational hours.

In a diaphragm pump of the above kind, the clamping of the diaphragm, which is achieved by clamping the peripheral portion of the diaphragm between the cylinder body and the cylinder cover, also serves to seal-off the working chamber from the atmosphere, so that a design of this kind only permits maximum delivery pressures of 350 bars to be attained, because the diaphragm pump must remain leak-proof, which is of particular importance when pumping critical materials, such as toxic or abrasive agents being metered.

Thus, if higher delivery pressures of more than 350 bars are required, diaphragm pumps of the other above-mentioned design, i.e. with metal diaphragms, must be used. However, because of their nature, metal diaphragms only permit of small elastic deformations, so that the diameter of the diaphragm area undergoing displacement must be substantially greater than in the case of plastic diaphragms.

Furthermore, the machining of the sealing surfaces, i.e. the clamping surfaces of the metal diaphragm, and the surface finish of the diaphragm material must meet highest quality requirements. The larger diameters of the metal diaphragms also lead to greater forces being imposed upon the bolts clamping the diaphragm. Diaphragm pumps having metal diaphragms are therefore much larger and more expensive than those having plastic diaphragms. In addition, their reliability in operation is lower, because metal diaphragms are more prone to breakage, which may easily be caused, for example, by suspended or dirt particles in the material being pumped.

SUMMARY OF THE INVENTION

It is therefore the object of the present invention to overcome the stated disadvantages by developing a diaphragm pump of the kind initially described in such manner that it becomes suitable for use at delivery pressures far exceeding 350 bars and simultaneously permits to use reliable plastic diaphragms of high displacement capacity.

In accordance with the present invention, to achieve the above object a pressure balancing space is provided to be radially outside and to encircle the diaphragm clamping surface, the pressure balancing space communicating with the working chamber or with the hydraulic fluid reservoir through at least one communicating passage, and a separate annular seal member is disposed to be radially outside the pressure balancing space between the cylinder cover and the cylinder body to seal-off the pressure balancing space and the working chamber from the outside.

The invention is based upon the concept of relieving the clamping surface of the diaphragm from its sealing function, which it previously had to perform simultaneously, i.e. the concept of clamping the diaphragm with exactly defined deformation between the cylinder cover and the cylinder body in pressure-balancing arrangement in such manner that the same pressure, which is the pressure of the working chamber, is always maintained radially inside as well as radially outside the diaphragm clamping surface. This provides the significant advantage that not only need the diaphragm clamping surface no longer perform any sealing function, but that also a plastic diaphragm may be used even when the diaphragm pump is required to perform at delivery pressures far exceeding 350 bars, the plastic diaphragm having, in comparison with a metal diaphragm, the already described advantages of a large displacement capacity, an insensitivity to impact damage, a long life and a small diameter, amongst others.

In the diaphragm pump according to the present invention the working chamber is sealed against atmosphere by means of a separate seal member. This manner of sealing presents no problems, because it need only prevent leaks of hydraulic fluid, usually consisting of mineral oil. Thus, the former difficult problem of having to provide a reliable seal for volatile, aggressive or toxic materials to be pumped under high pulsating pressures is reduced to the technologically simple matter of providing, in proven manner, a seal for oil under pulsating pressure. Known sealing elements, for example O-rings, may be used for this.

In order to put into practice the concept underlying the present invention, which is to always maintain the same pressure radially inside as well as radially outside the diaphragm clamping surface, a preferred embodiment of the present invention has a pressure balancing space chamber disposed to be radially outside the diaphragm clamping surface and to encircle the diaphragm clamping surface, in particular having the form of an annular groove formed in the end face of the cylinder body, the pressure balancing space communicating with the working chamber through at least one communicating passage. This communicating passage may communicate directly with the working chamber or may lead into a blind hole or bore in the cylinder body in which a relief valve arrangement communicating with the hydraulic fluid reservoir is received and which in turn communicates with the working chamber through a further passage.

In order always to maintain the same pressure on both sides of the diaphragm clamping surface and thereby to relieve the diaphragm clamping surface from the function of providing a seal, it is also possible in alternative manner to form the pressure balancing space including its communicating passage to be integral with the working chamber by forming the working chamber to be suitably large along the radial direction and thus to extend radially beyond the diaphragm clamping surface. With this design the clamping surface of the diaphragm is then attached to the end face of the cylinder cover by means of a separate locking ring disposed within the working chamber, wherein this locking ring is suitably formed as an orifice plate and thus serves to support the diaphragm in its lower dead center position during the suction stroke of the displacement piston.

Thus, the diaphragm pump designed in accordance with the present invention may be fitted with operationally reliable plastic diaphragms of high displacement capacity and delivery pressures of up to 1200 bars, for example, may be attained during a diaphragm lifetime exceeding 20,000 operational hours.

BRIEF DESCRIPTION OF THE DRAWINGS

The invention will be further described, by way of example, with reference to the accompanying drawings, in which.

DETAILED DESCRIPTION OF THE INVENTION

Figure 1:
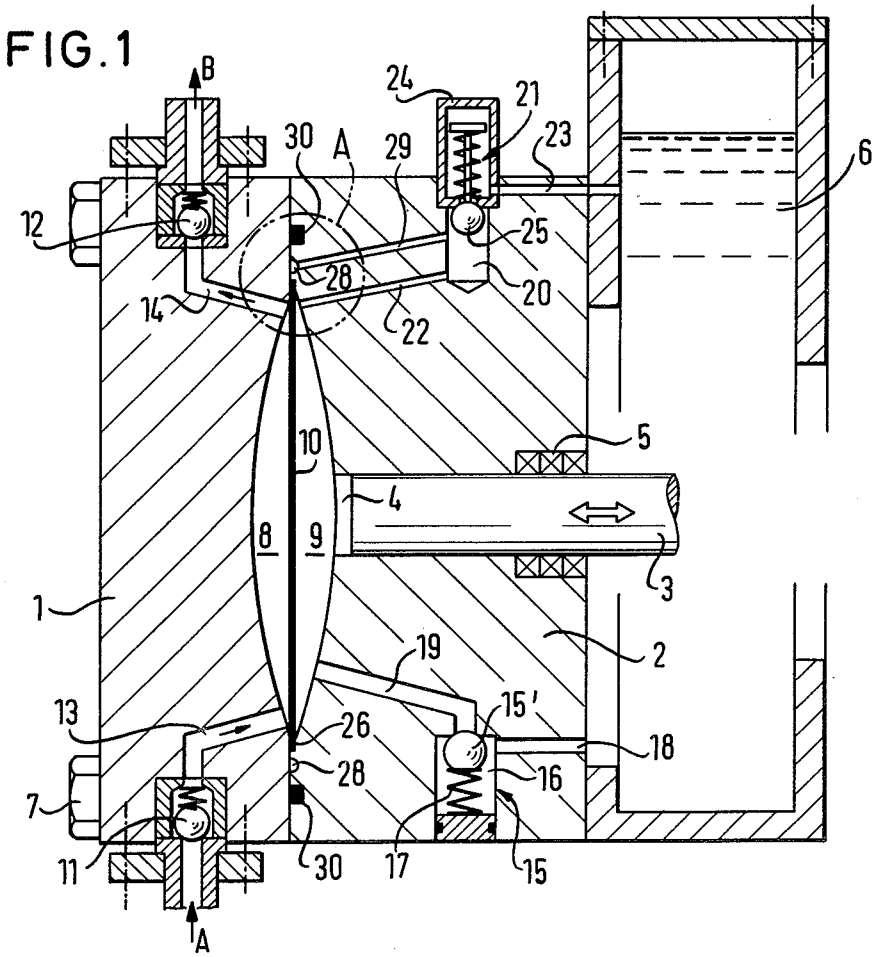
FIG. 1 shows a schematic cross-section of a diaphragm pump according to the present invention.

As is evident from FIG. 1, the illustrated diaphragm pump includes a pump housing formed by a cylinder body 2, which has its end face closed by a cylinder cover 1 and within which an oscillating or reciprocating displacement piston 3 is adapted to function as a hydraulic diaphragm drive means. The displacement piston 3 is mechanically slidable to and fro within an axial bore 4 of the cylinder body 2 and is sealed by a sealing package 5 with respect to a hydraulic fluid reservoir 6.

The cylinder cover 1 is releasably attached to the end face of the cylinder body 2 by means of bolts 7, a delivery or pumping chamber 8 and a working chamber 9 filled with hydraulic fluid being formed within the confronting end faces of the cylinder cover 1 and the cylinder body 2 by suitably large concave recesses having the same diameter. The working chamber 9, having its bottom centrally opened into the bore 4 of the cylinder body 2 slidably guiding the displacement piston 3, is partitioned from the delivery chamber 8 by a plastic diaphragm 10, which in the case of the illustrated example of embodiment consists of a single diaphragm, but which may also be formed by a plurality of diaphragms in sandwich arrangement and which, in any case, is firmly clamped between the cylinder cover 1 and the cylinder body 2 in a manner to be described in the following.

The cylinder cover 1 is provided with a spring-loaded inlet valve 11 and a spring-loaded outlet valve 12, the valves 11, 12 communicating with the delivery chamber 8 through an inlet passage 13 and an outlet passage 14, respectively, in such manner that when the diaphragm 10 performs a suction stroke by moving to the right, as seen in FIG. 1, the material being pumped is sucked in the direction of the arrow A through the inlet valve 11 and the inlet passage 13 into the delivery chamber 8, and when the diaphragm 10 performs a compression or delivery stroke by moving to the left, as seen in FIG. 1, the material being pumped is ejected in dosaged quantity from the delivery chamber 8 through the outlet passage 14 and the outlet valve 12 in direction of the arrow B.

In order to prevent the diaphragm 10 and the entire diaphragm pump from being overloaded during the diaphragm delivery stroke, a relief valve 15, serving to afford protection from excessive pressure, is provided within the cylinder body 2, the relief valve 15 including a valve ball member 15' urged by an adjustable spring 17 and disposed at the bottom of a blind bore 16 of the cylinder body 2 in the manner illustrated, wherein the blind bore 16 communicates with the hydraulic fluid reservoir 6 through a passage 18 and with the working chamber 9 through a passage 19. As is evident, this arrangement and design of the relief valve 15 thus enables the working chamber 9 to communicate with the hydraulic fluid reservoir 6 through the passage 19, 18 and the pressure of the working chamber 9 to be reduced, in case an inadmissibly high pressure is built up within the working chamber 9 during the delivery stroke of the diaphragm 10.

In corresponding manner a relief valve 21 is disposed within another blind bore 20 of the cylinder body 2 to provide communication between the working chamber 9 and the hydraulic fluid reservoir 6 for the purpose of affording protection from subpressure when the diaphragm 10 is in abutment against the working chamber wall during the diaphragm suction stroke. For this purpose the blind bore 20 communicates with the working chamber 9 through a passage 22 and with the hydraulic fluid reservoir through a passage 23, whilst the relief valve 21 includes, in the manner illustrated, a spring-loaded valve ball member 25, which abuts against the lower side of the bottom of an insert member 24 and which separates from the bottom of the insert member 24 when a certain, preset subpressure is attained, thus providing communication between the working chamber 9 and the hydraulic fluid reservoir 6 through the passages 22, 23.

At the same time the relief valve 21 serves to vent the working chamber 9, i.e. to degas the hydraulic fluid contained within the working chamber 9. For this purpose the passage 22 in the cylinder body 2 is designed to be inclined upwards in such manner that its geodetically lower end (left-hand passage end in FIG. 1) is connected with the geodetically highest position of the working chamber 9 and its geodetically higher end (right-hand passage end in FIG. 1) is connected with the blind bore 20, so that self-acting, functionally reliable degassing of the hydraulic fluid bore and venting of the working chamber 9 is always achieved.

Figure 2:
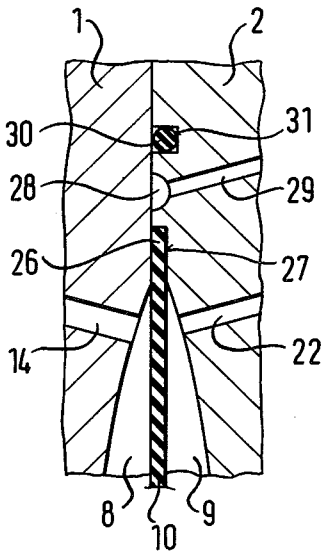
FIG. 2 shows a magnified cross-section of the detail A of the diaphragm pump according to FIG. 1.

As evident from FIG. 1 and particularly clear from FIG. 2, the diaphragm 10 is firmly clamped at a clamping surface 26 formed by its peripheral edge portion between those portions of the confronting end faces of the cylinder body 2 and the cylinder cover 1 which are adjacent to the delivery chamber 8 and the working chamber 9, the diaphragm clamping surface 26 being set into an annular recess 27 formed in the end face of the cylinder body 2. In direction radially outwards from the diaphragm clamping surface 26 a circular pressure balancing space 28, in form of a chamber encircling the diaphragm clamping surface 26 is formed in the end face of the cylinder body 2 in the shape of an annular groove. In the illustrated example of embodiment the pressure balancing space 28 communicates through a single communicating passage 29 formed in the cylinder body 2 with the blind bore 20 receiving the relief valve 21—and thus with the working chamber 9 through the passage 22. Thereby it is ensured that the same pressure is always maintained radially outwards as well as radially inwards from the diaphragm clamping surface 26, i.e. within the working chamber 9 as well as within the pressure balancing space 28, and that the diaphragm clamping surface 26 is thus relieved from pressure.

As may be seen from the drawings, the communicating passage 29 is formed to be inclined upwards within the cylinder body 2 in the same way as the passage 22 and is disposed so as to lead from the geodetically highest position of the pressure balancing space 28 to the geodetically highest position of the working chamber 9, i.e. via the blind bore 20 and the passage 22, so that in this manner provision is also made for reliable degassing of the pressure balancing space 28.

The sealing of the working chamber 9 and the pressure balancing space 28 with respect to the outside is made by means of a separate annular seal member 30 which is set into an annular groove 31 formed in the end face of the cylinder body 2 radially outwards from the pressure balancing space 28.

Figure 3:
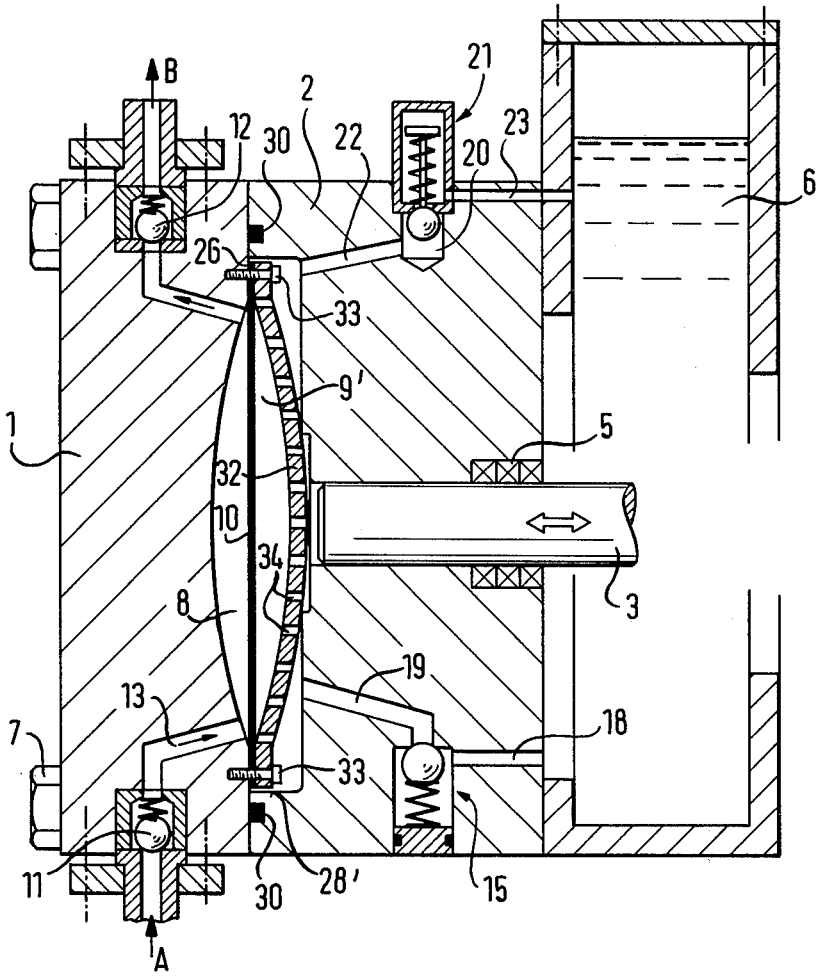
FIG. 3 shows a cross-section of a modified embodiment of the diaphragm pump.

In the modified embodiment of the diaphragm clamping means according to FIG. 3, the diaphragm 10 has its clamping surface 26 fixed to the end face of the cylinder cover 1 by a separate locking ring 32 by means of bolts 33, the locking ring 32 being designed in the form of an orifice plate having a plurality of axially parallel through-bores 34.

This orifice plate provides a satisfactory rear-side diaphragm support during the diaphragm suction stroke and is received within the working chamber 9'. In the illustrated example of embodiment the working chamber 9' is designed to have a greater diameter than the delivery chamber 8 and has accordingly been extended in radial direction beyond the diaphragm clamping surface 26. An annular space 28' is hereby formed radially outside the diaphragm clamping surface 26 within the working chamber 9'. This annular space 28' represents a pressure balancing space—integrally formed with the working chamber 9'—and ensures that the same pressure is always maintained radially outside as well as radially inside the diaphragm clamping surface 26. Because of this specific—enlarged—design of the working chamber 9' it is not necessary for the annular space 28' representing the pressure balancing space to be additionally connected with the working chamber 9' through a separate communicating passage (corresponding to the communicating passage 29 according to FIGS. 1 and 2). In other words, the separate communicating passage including the pressure balancing space 28' forms a part of the working chamber 9' itself.

As evident from FIG. 3, in this embodiment an annular seal member 30 is also provided radially outside the pressure balancing space 28 between the adjoining end faces of the cylinder body 2 and the cylinder cover 1, the annular sealing member 30 sealing-off the hydraulic fluid contained within the working chamber 9' and the pressure balancing space 28' from the outside.

Figure 4:
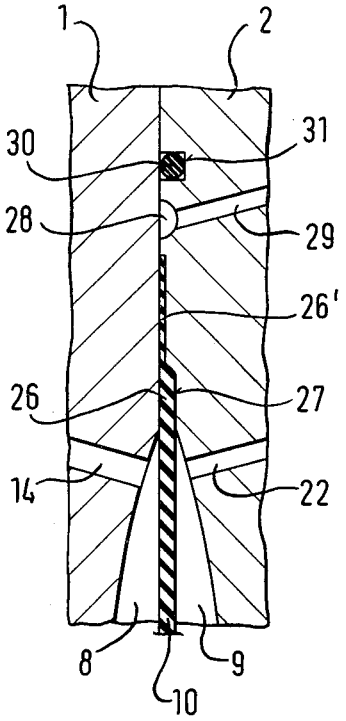
FIG. 4 shows a further, modified embodiment illustrated in detail in a manner similar to that of FIG. 2.

The further modified embodiment according to FIG. 4 differs from that according to FIGS. 1 and 2 merely in that the diaphragm 10 is additionally provided at its clamping surface 26 with an outer edge portion 26' having a substantially smaller thickness than the diaphragm main body, wherein the thickness of this outer clamping edge portion 26' is preferably about 5 to 20% of the thickness of the diaphragm main body. Furthermore, the width of the outer clamping edge portion 26' should be at least 10 times its thickness.

With this design of the diaphragm clamping surface 26 including the thinner, outer, clamping edge portion 26' the advantage of even greater reliability of sealing and clamping may be achieved.

It is possible for a fault to occur, in particular even when the diaphragm pump is inoperative, wherein the pressure within the delivery chamber 8 becomes greater that within the working chamber 9, for example when the outlet valve 12 jams or when its spring breaks etc. In case of such faulty operation the diaphragm 10 is displaced or deflected—in the same way as it is during its suction stroke movement—and pressed against the concave supporting surface of the working chamber 9, when the clamping edge portion of the diaphragm 10 formed by the normal clamping surface 26 is subject to excessive stress. This arises because the pressure existing within the delivery chamber 8 at this moment acts upon the delivery side of the diaphragm surface without being simultaneously compensated by a corresponding pressure within the working chamber 9. Consequently the diaphragm 10, which is acted upon in this manner, becomes slightly deformed on the delivery side of its normal clamping surface 26, so that a gap is formed, through which the material being pumped may seep from the delivery chamber 8 into the working chamber 9.

This is however effectively prevented by the thin outer clamping edge portion 26', which is provided in addition to the normal clamping surface 26. Owing to its smaller thickness—in combination with a certain minimum width—the outer clamping edge portion 26' exerts an adhesive effect, because the thin diaphragm material adheres to the minute projections or raised portions causing the normal surface roughness of the metall sealing faces of the cylinder cover 1 and the cylinder body 2, and is thus prevented from creeping or flowing in undesired manner. Thus, even in case of the above-mentioned faulty operation, none of the material being pumped can penetrate into the working chamber 9 from the delivery chamber 8 past the outer clamping edge portion 26' of the diaphragm 10.

What is claimed is:

1. A diaphragm pump including at least one diaphragm separating a delivery chamber from a working chamber filled with a hydraulic medium, said diaphragm being firmly clamped between a cylinder body and a cylinder cover at a clamping surface formed by the peripheral edge portion of said diaphragm, and further including hydraulic diaphragm drive means in the form of a reciprocating displacement piston slidably disposed within said cylinder body between said working chamber and a hydraulic fluid reservoir, characterized in that a pressure balancing space is provided to be radially outside and to encircle said diaphragm clamping surface, said pressure balancing space communicating with said working chamber or with said hydraulic fluid reservoir through at least one communicating passage, and in that a separate annular seal member is disposed to be radially outside said pressure balancing space between said cylinder cover and said cylinder body to seal-off said pressure balancing space and said working chamber from the outside.

2. A diaphragm pump according to claim 1, wherein said separate annular seal member is set into an annular groove formed in the end face of said cyinder body.

3. A diaphragm pump according to claim 1 or 2, wherein said clamping surface of said diaphragm is fixed to the end face of said cylinder cover by a separate locking ring disposed within said working chamber and said working chamber receiving said locking ring is enlarged in radial direction to extend beyond said diaphragm clamping surface in such manner that said pressure balancing space is integrally formed together with said working chamber.

4. A diaphragm pump according to claim 3, wherein said diaphragm is of substantially smaller thickness at the outer edge portion of its clamping surface than within the area of its main body portion.

5. A diaphragm pump according to claim 1 or 2, wherein said pressure balancing space is formed as an annular groove provided in the end face of said cylinder body, at least one position of said annular groove communicating with said working chamber through said communicating passage extending within said cylinder body.

6. A diaphragm pump according to claim 5, wherein said communicating passage leads from the geodetically highest position of said pressure balancing space to the geodetically highest position of said working chamber.

7. A diaphragm pump according to claim 5, wherein said diaphragm is of substantially smaller thickness at the outer edge portion of its clamping surface than within the area of its main body portion.

8. A diaphragm pump according to any one of claims 1 or 2, wherein said diaphragm is of substantially smaller thickness at the outer edge portion of its clamping surface than within the area of its main body portion.

9. A diaphragm pump according to claim 8, wherein the width of the thin outer edge portion of said diaphragm is at least 10 times the thickness of said diaphragm.

10. A diaphragm pump according to claim 8, characterized in that the thickness of the thin outer edge portion is about 5 to 20% of the thickness of said main body portion of said diaphragm.

11. A diaphragm pump according to claim 10, wherein the width of the thin outer edge portion of said diaphragm is at least 10 times the thickness of said diaphragm.

12. A diaphragm pump according to claim 1, wherein said communicating passage leads from the geodetically highest position of said pressure balancing space to the geodetically highest position of said working chamber.

13. A diaphragm pump according to claim 12, wherein said diaphragm is of substantially smaller thickness at the outer edge portion of its clamping surface than within the area of its main body portion.

* * * * *